United States Patent [19]

Amadio

[11] 4,099,442

[45] Jul. 11, 1978

[54] CORRECTIVE DEVICE FOR CLARINETS

[76] Inventor: Clive Lyof Amadio, 171 Soldiers Point Road, Salamander Bay, New South Wales 2301, Australia

[21] Appl. No.: 780,605

[22] Filed: Mar. 24, 1977

[30] Foreign Application Priority Data

Mar. 29, 1976 [AU] Australia ..... 5406/76

[51] Int. Cl.[2] ..... G10D 7/06

[52] U.S. Cl. ..... 84/382; 84/453; 84/465

[58] Field of Search ..... 84/380, 382, 453, 465

[56] References Cited

U.S. PATENT DOCUMENTS 2,556,535 6/1951 Hansen ..... 84/382

2,918,838 12/1959 Worrel ..... 84/382 X 2,933,968 4/1960 Hearne ..... 84/382 X

*Primary Examiner*—John Gonzales

*Attorney, Agent, or Firm*—J. Harold Nissen

[57] ABSTRACT

A clarinet is provided with a post protruding above the keys adjacent the A key to limit the extent that the clarinetist can move his finger along the clarinet barrel over the convex surface of the A key and away from the F sharp key. The post provides a corrective device to assist the pupil clarinetist to locate his fingers correctly to execute the clarinet break. The post is removable so that it is essentially a teaching device alone. The post may form part of a clip attachment which can be fitted to the clarinet barrel when the pupil is under instruction.

5 Claims, 3 Drawing Figures

CORRECTIVE DEVICE FOR CLARINETS

FIELD OF THE INVENTION

This invention relates to clarinets and is more specifically concerned with a corrective device for assisting a pupil to master the clarinet "break".

STATE OF THE ART

The clarinet covers a wide range of octaves and has numerous keys arranged around its barrel and distributed around its length. Some of these keys are very close to one another and a special technique has to be adopted if the player is to release the A-key and press the neighbouring F-sharp key correctly. The movement of the player's finger between these two positions is known as the clarinet break.

The F-sharp key comprises a ring surrounding the hole in the clarinet barrel which is closed by the player's finger when the F-key is depressed. The A-key of the clarinet extends lengthwise of the barrel, and its playing surface is convexly curved like the underside of a spoon. The correct technique the player must adopt to move his finger from the spoon surface of the A key onto the F-sharp key, is a rolling action about the side edge of the finger. A sliding action between the two keys cannot be tolerated.

It is necessary for a clarinetist to play the break frequently, and the A-key and F-sharp key are placed close to one another in consequence. A clarinet pupil is naturally not familiar with the precise positioning of his fingers on the clarinet keys, and very often, the natural position of his finger on the A-key convex surface is sufficiently far from the F-sharp key to prevent the break being executed correctly. The player's finger then has to slide from the A key to the F-sharp key, which quickly becomes a habit and impairs the player's ability to master the correct technique for clarinet playing.

OBJECT OF THE INVENTION

An object of this invention is the provision of a device to assist a clarinet player to master the break.

THE INVENTION

In accordance with one aspect of this invention a clarinet is provided between the convex surface of the A-key and the A-flat key, with a post which limits the extend that the finger of the clarinetist can be moved over the convex surface of the A-key in a direction away from the F-sharp key.

In accordance with a second aspect of the invention a corrective device for fitting to a clarinet comprises a clamp for attaching to the body of the clarinet and which holds in place a slide-bar shaped to extend alongside the convex surface of the A-key and on which is an adjustably positionable post which is arranged to be upright alongside the convex surface of the A-key to limit the extent to which a player's finger can move along the A-key in a direction away from the F-sharp key.

PREFERRED FEATURES OF THE INVENTION

Preferably the clamp comprises a split part-ring which can be tightened, by a screw, around the clarinet barrel on the side of the F-sharp key opposite to the A-key. The bar suitably comprises a thin metal bar which extends alongside the F-sharp key, on the side opposite its hinge, to a position adjacent the hinge of the A-key and between the convex surface of the latter and the hinge of the A-flat key. The end-portion of the bar is preferably flattened and the post is conveniently attached to an aperture boss containing a grub screw and which is shaped on its underside to fit against the clarinet barrel. The position of the flattened surface of the bar is such that when the grub screw is tightened the post attached to the boss projects upwards about half-an-inch beyond the convex surface of the A-key. The clarinetist is able to position the post to suit his comfort, and, once positioned, it prevents him from advancing his finger further away from the F-sharp key than is possible for him to accomplish the clarinet break with the correct rolling action.

The invention will now be described in more detail, by way of example, with reference to the accompanying diagrammatic drawings.

IN THE DRAWING

PREFERRED EMBODIMENT

Figure 1:
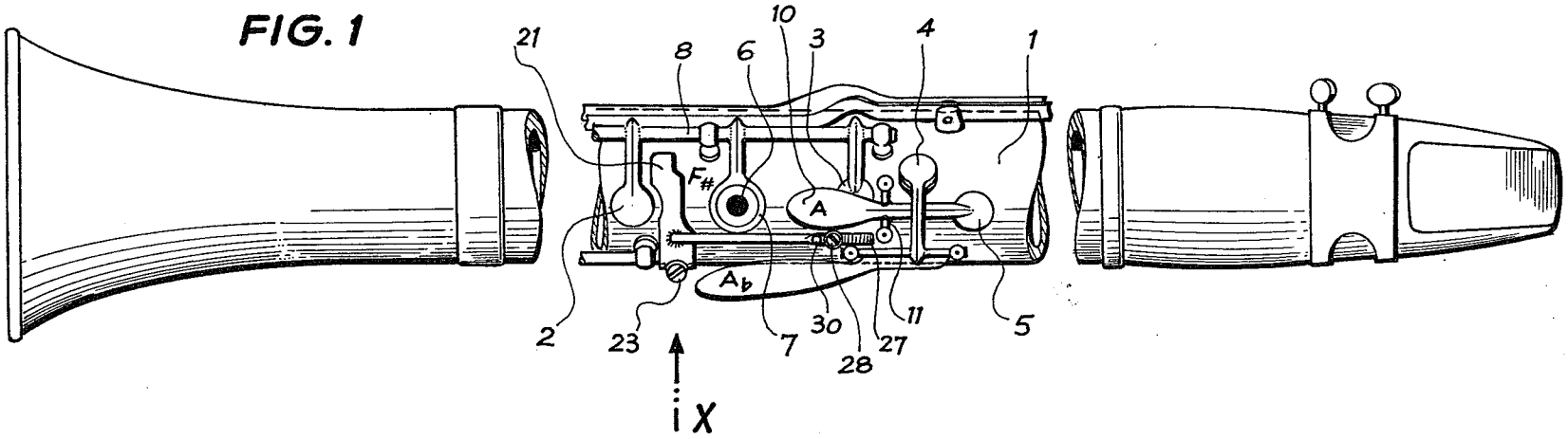
FIG. 1 is a side view of a clarinet barrel partly broken away and shows in detail the part of the barrel where the break position is encountered.

FIG. 1 shows parts of the clarinet barrel 1. The barrel has a number of holes distributed along its length and which are covered by valves, some of which are shown at 2, 3, 4 and 5. One of the holes, referenced 6, is open and is surrounded by a ring-shaped key 7 which controls the closure of the valve 3, by rotating a hinge spindle 8 to which an arm of the ring 7 is attached. From FIG. 1 the extent of cluttering of the barrel by the clarinet valves is clearly apparent.

The valve 5 is opened by the player depressing the A-key 10. The playing surface of this key is convexly curved in the same way as the underside of a spoon. The key is hinged about a trunnion 11 and it also controls operation of the valve 4 which is provided with an adjustable rocker engaging the key 10 on the opposite side of the trunnion 11 to the playing surface of the key.

The movement of a player's finger from the convex-spoon-like surface of the key 10 to the adjacent position where the ring 7 is depressed and simultaneously the finger covers the hole 6, is called the clarinet break. It can only be correctly performed by a rolling motion of the player's finger down the convex surface of the key 10 towards the ring 7.

The extent that a player can roll his finger depends partly on his hand size and partly on the other keys which the player may have to depress simultaneously or next in the sequence of notes he is playing. There are therefore severe restrictions on the position of the finger on the surface of the key 10 and for this reason it is convexly curved to assist the player execute the correct rolling action. Unfortunately, there is a natural disinclination for a pupil to leave his finger resting on the downwardly sloping convex surface, because it is not comfortable, and therefore he tends to keep his finger much nearer the trunnion 11 of the key 10 than is possible if the correct rolling action necessary to accomplish the break is to be executed.

Figure 2:
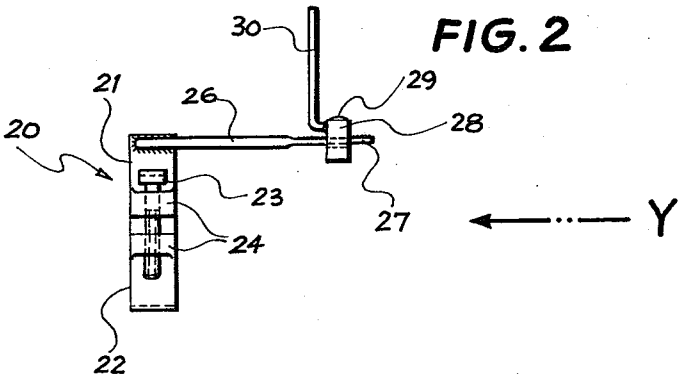
FIG. 2 is a side view of a correction device unclamped from the clarinet barrel and as seen when looking in the direction of the arrow X in FIG. 1; and, FIG. 3 is an end view of the device of FIG. 2 as seen when looking in the direction of the arrow Y in that Figure.
Figure 3:
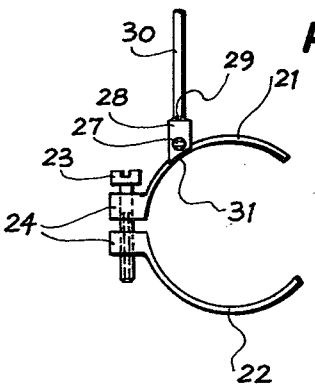

To train a pupil to position his finger controlling the break, correctly on the key 10, the device shown in FIGS. 2 and 3 has been developed. The device comprises a part ring 20 split to provide two parts 21, 22 which are clamped together by tightening a screw 23 passing through a pair of threaded lugs 24 on respective parts of the ring. The ring is made from a strong metal such as stainless steel, and the two parts are so shaped that they can be clamped to the clarinet barrel at the position shown in FIG. 1 without obstructing either the keys or the path of movement of the clarinetist's fingers when playing.

The part 21 of the device has soldered to it a slide bar 26 the end portion 27 of which is flattened on one side. An apertured boss 28 is slidable along the flattened portion 27 and a grub screw 29 is tightenable to fix the position of the boss 28 with respect to the end-portion 27. The flattened surface of the end-portion 27 is striated to assist clamping of the boss 28 in a chosen position by the action of tightening the grub screw 29.

Soldered to the side of the boss 28 is a post 30. The underside of the boss 28 is cut slant-wise, as shown at 31, to nest snugly against the outside of the clarinet barrel 1. This prevents the bar 26 behaving as a cantilever which could result in the post 30 exhibiting an undesirable resilience.

METHOD OF USE OF PREFERRED EMBODIMENT

The part-ring 20 of the corrective device is clamped to the clarinet barrel as shown in FIG. 1 which shows clearly how the part 21 is shaped to grip the clarinet barrel 1 between the position of the ring-key 7 and the valve 2. A high-friction facing (not shown) is provided on the concave surfaces of the two parts 21 and 22 to prevent them slipping on the barrel of the clarinet when the screw 23 is tightened.

The bar 26 extends axially of the clarinet when the screw 23 is tightened and passes alongside and beneath the position of the ring 7 so that its end-portion 27 lies between the hinge axis of the arm of the valve 4 and the adjacent convex surface of the key 10. The spacing between the key 10 and the hinge of the valve 4 is sufficient for the boss 28 to be moved to any desired position along the length of the flattened-end portion 27. When the correct position has been found, the screw 29 is tightened and the post projects upwards alongside the convex surface of the key 10 to prevent the player's finger from advancing up the convex surface further than the position of the post. This post position is such that the player can comfortably execute the rolling action to transfer his finger from the key 10 to the ring 7 while simultaneously covering the hole 6.

The corrective device is simple to attach and detach from a clarinet. It is also adjustable to suit the player. The post 30 automatically locates the player's finger at the correct position to enable him to execute the break. It is also adjustable to enable different players to use the device. The provision of the device on an instrument is not noticed by the player apart from the automatic effect it has in ensuring that the player's finger is correctly positioned to execute the break. If desired the post 30 may be slot-ended to receive a screwdriver and maybe screwed directly into a threaded socket in the boss 28.

MODIFICATIONS OF THE INVENTION

Although the figures illustrate a detachable device which can be fitted to a conventional clarinet of the prior art, it is to be understood that a clarinet may be made with means for enabling the post 30 to be fitted at the correct position when desired. For example, although not illustrated, it will be appreciated that the post may be provided with a threaded end enabling it to be screwed into a threaded socket piece capable, preferably, of being slid axially to different positions along the barrel corresponding to the positions provided by the bar 26 in FIG. 1. For instance, the socket piece may be movable along an axial slot let into the clarinet barrel beneath the position shown for the bar 26, and provided with an expanding element into which a bolt can be screwed to expand the socket piece in the slot so that it is effectively clamped at a chosen position suited to the clarinetist's size of hand. The post 30 can then be fitted to the socket piece, when required, so that it stands up at the desired position. When not required the post can be accommodated in one end portion of the barrel slot for the socket piece and held in place by fitting it into one side of the socket piece which can be clamped at a suitable position so that the post is held in a convenient storage position.

I claim:

1. A clarinet having a barrel, an A-key having a convex surface, an F-sharp key and an A-flat key on said barrel, said keys being adjacent one another, and a post projecting from said barrel adjacent said A-key whereby said post limits the extent that the finger of a clarinetist can move axially of the clarinet barrel over the convex surface of the A-key in a direction away from the F sharp key.

2. A clarinet as set forth in claim 1, fitted with a corrective device comprising clamping means for attaching it to the clarinet barrel, a slide bar shaped to extend alongside the convex surface of the A key and on which said post is slideable, and means for locking said post at a chosen position on said slide bar.

3. A clarinet as set forth in claim 2, in which said clamping means comprises a split part-ring which can be tightened, by a screw, around the clarinet barrel on the side of the F-sharp key opposite to the A-key.

4. A clarinet as set forth in claim 3, in which said bar extends alongside the F-sharp key, on the side opposite its hinge, to a position adjacent hinging means of the A-key and between the convex surface of the latter and hinging means of the A-flat key.

5. A clarinet as set forth in claim 4, in which an end-portion of said bar remote from said split part-ring is flattened, an apertured boss supports said post and is shaped to fit against the clarinet barrel, said bar extends through the aperture of said boss, and a tightenable means on said boss locks it at a chosen position on said bar.

* * * * *